United States Patent [19]

Belitsin et al.

[11] 4,054,709

[45] Oct. 18, 1977

[54] MAN-MADE FIBRE, YARN AND TEXTILE PRODUCED THEREFROM

[76] Inventors: Mikhail Nikolaevich Belitsin, 2 Donskoi proezd, 6, kv. 9, Moscow; Alexandr Gamsheevich Borik, Borodinsky proezd, 7, kv. 7, Klin Moskovskoi oblasti; Galina Akimovna Kudryashova, ulitsa Mira, 16, kv. 33, Klin Moskovskoi oblasti; Sergei Alexandrovich Kudryashov, ulitsa Mira, 16, kv. 33, Klin Moskovskoi oblasti; Eleonora Viktorovna Goncharova, Lomonosovsky prospekt, 34a, kv. 51, Moscow; Natalia Alexandrovna Sadkova, Oxkaya ulitsa, 22/2, kv. 13, Moscow; Serafim Alexandrovich Pavlov, Leninsky prospekt, 34/1, kv. 293, Moscow; Valentin Vladimirovich Kulikov, Leningradskoe shosse, 44, kv. 58, Klin Moskovskoi oblasti; Galina Petrovna Tolpygina, Maidanovo, 1, kv. 2, Klin Moskovskoi oblasti; Tatyana Nikolaevna Gotie, ulitsa Krasnaya, 1/27, kv. 24, Klin Moskovskoi oblasti; Elena Grigorievna Toropova, ulitsa Gagarina, 47, kv. 23, Klin Moskovskoi oblasti; Nina Ivanovna Ermolina, Borodinsky proezd, 7, kv. 7, Klin Moskovskoi oblasti; Ivan Vasilievich Puchnin, Nakhimovsky prospekt, 23, korpus 5, kv. 34, Moscow, all of U.S.S.R.

[21] Appl. No.: 596,833

[22] Filed: July 17, 1975

[51] Int. Cl.[2] ..... D02G 3/00; D02G 3/02

[52] U.S. Cl. ..... 428/224; 57/140 J; 57/140 R; 428/365; 428/397

[58] Field of Search ..... 428/397, 399, 395, 224, 428/365; 57/140 R, 140 J

[56] References Cited

U.S. PATENT DOCUMENTS

| | | | |
|---|---|---|---|
| 2,174,991 | 10/1939 | Masland | 28/1 |
| 2,373,892 | 4/1945 | Hickey | 428/397 X |
| 3,121,040 | 2/1964 | Shaw et al. | 428/397 |
| 3,156,085 | 11/1964 | Jamieson | 428/224 |

FOREIGN PATENT DOCUMENTS

| | | | |
|---|---|---|---|
| 1,330,845 | 5/1963 | France | 428/397 |

*Primary Examiner*—Lorraine T. Kendell
*Attorney, Agent, or Firm*—Steinberg & Blake

[57] ABSTRACT

This invention relates to man-made fibres particularly adapted for use in yarns and household fabrics, that is fabrics for end use in dresses, blouses, head shawls, shirts and so on.

The man-made fibre of this invention displays a complex cross-sectional shape formed of two elements, each of these elements comprising three rays outgoing from a single point, two adjacent rays making up an angle of 10° to 70° and free ends of middle rays being interconnected by a flexible bridge. Such a man-made fibre contributes appreciably to moisture conductivity and moisture absorption in yarns and textiles produced from this fibre, making their moisture conductivity and moisture absorption approximate those of natural silk textiles.

6 Claims, 7 Drawing Figures

MAN-MADE FIBRE, YARN AND TEXTILE PRODUCED THEREFROM

This invention relates to shaped man-made fibres, textile yarns and textiles produced from such fibres.

This invention can most effectivelly be used in commercial manufacture of household textiles and knitted goods such as fabrics for end use in dresses, blouses, shirts, head shawls, underwear articles, and hosiery.

Known in the present state of the art are methods of structural, chemical and physical modification of fibres.

Structural modification consists in changing the size, mutual attitude and orientation of macromolecules and particularly elements of supermolecular structure in a fibre.

Chemical modification lies in changing the chemical composition of fibres.

Methods of physical modification are extensevely used for controlling the spinning process in the fibre production or in respect to the ready-made fibre.

Physical modification resides in changing the shape, dimensions, arrangement of fibre, the manner in which they are interlinked, and in respective changing their manufacturing and processing technology.

Physical modification makes it possible to introduce well-controlled changes into any particular property or into a whole range of properties of the fibre subject to modification and thus to produce silk-wool-cotton- and flax-like fibres.

One of the most widely and effectively used methods of physical modification is changing the shape of filament-forming hole in the spinneret, changing thereby the cross-sectional shape of fibre as well.

Man-made fibers are known, having various cross-sectional shapes (triangular, pentagonal, hexagonal, six-pointed, peanut-shaped, cordate, asymmetrically striated) allowing for controlled lustre, deeper dye-penetration and evener dying, improved draping properties, higher resistance to soiling and pilling, and other external effects.

The use of these physically modified fibres makes it possible to considerably improve the properties and quality of textiles and impart a novel marketable appearance to the same.

The fact that natural fibres are critical commodities on the world market together with ever growing requirements to comfort properties of textiles dictated the creation of so-called silk-wool-cotton- and flax-like fibers and products therefrom.

Manufacturers are often in quest for a product, the appearance of which would resemble that of natural silk.

By way of example, according to the known U.S. Patent No. 3,508,390, Cl. 57-140, the shaped man-made fibre displays a Y-shaped cross-sectional configuration and when processed, would yield fabrics resembling natural silk with "dry" soft or somewhat stiffer hand. The fabrics of these fibres show a significantly improved dye-acceptivity. Besides, the fabrics of these fibres have the appearance of textured fabrics without texturizing process being used. The weave and texture of the fabric itself is better revealed. Synthetic filament yarns, e.g. those of nylon, composed of the known Y-shaped fibres were also found to exhibit such optical properties by virtue of which the fabrics acquire pleasant dull lustre. However, physical properties of these fibres, such as moisture absorption, moisture conductivity and heat conductivity, differ markedly from those of natural silk, and therefore the comfort properties of products are inadequate.

It is known that physical properties of man-made fibres can be made approximate those of natural silk via setting-up open capillary canals on the fibre surface. Into this category of fibers fall shaped man-made fibres displaying a complex cross-sectional configuration with three open capillary canals, these canals adding to mechanical cohesion of individual fibres (see, e.g. USSR Patent No. 117924 Cl. 29*a*, 6/04). However, the instability of the canals renders an increase of moisture conductivity and moisture absorption in these fibres impossible.

From the patents considered above it is apparent that the emphasis was placed on attaining purely external effects, e.g. providing either silk-like lustre, handle, draping properties or good mechanical cohesion, which is not feasible with the round and smooth cross section, commonly typical for all man-made fibres.

No patent can be cited to tackle the problem of modifying such physical properties of the fibre, which would ultimately improve the hygienic properties of products produced therefrom and allow obtaining comfort characteristics analogous to those of natural silk.

The object of this invention is to provide a man-made fibre with such a cross-sectional shape which would allow obtaining geometric properties, particularly the shape and the bulk closely approximating those of natural silk.

The principal object of this invention is to provide a man-made fibre which would allow obtaining physical properties, particularly water absorption, water conductivity and heat conductivity closely approximating those of natural silk.

Another object of this invention is to provide a man-made fibre with the above stated cross-sectional shape, which would allow obtaining mechanical properties, particularly strength, resilience and flexibility closely approximating those of natural silk.

An equally important object of this invention is to provide a man-made fibre with the above-stated shape which would significantly improve the comfort properties of products made from this fibre.

These and other objects are attained by provision of a man-made fibre displaying a complex cross-sectional shape with open capillary canals adding to mechanical cohesion of individual fibres, in which fibre complex shape is formed of at least two elements, each of these comprising three rays outgoing from a single point, two adjacent rays making up an angle of 10° to 70° while free ends of middle rays are interconnected by a flexible bridge of the same material.

Such cross-sectional shape diminishes the glitter characteristic inherent in fibres with circular cross-sectional configuration. This is accounted for by that light rays reflected from the inner surface of fibre elements are intersecting to develop a kind of delustering effect, which results in their reduced reflection power.

Besides, the presence of rays and flexible bridge ensures a resilient (elastic) connection of the elements and allow setting-up capillaries which over their whole run communicate with the outer fibre surface. This significantly contributes to moisture conductivity.

Thus, the principal properties of the fibre-lustre, flexibility and water conductivity are closely approximating those of natural silk.

In order to increase fibre capillarity it is preferable that a third element identical to the first two be connected to the middle of the bridge.

To raise the resilience and flexibility of the fibre of this invention, the middle portion of the bridge has a zigzag configuration.

Moreover, according to the invention, at least one of the elements has an additional ray outgoing from the same point as the other rays of this element and forming a continuation of the middle ray not exceeding that of each ray not interconnected by the bridge.

The presence of the additional ray increases the concavity of the fibre and thus reduces its reflecting power to make it approximate the reflecting power of natural silk, i.e., the fibre exhibits a soft shimmering lustre.

According to the invention, the yarn composed of the proposed fibres displays a twist within 100 to 2000 T.P.M.

Said twist allows advantageously arranging the capillaries at a definite angle to the surface.

Such an arrangement of the capillaries with said twist is provided through their inclination to the yarn axis, which aids in transferring moisture from one side of the product to another.

The lowered twist decreases the inclination angle of the capillaries and, hence, the moisture conductivity.

An excessive high-twist may be the cause for an overtight yarn, which would bring about lowered moisture conductivity and raised stiffeness.

Thus, in order to provide most favourable conditions for moisture conductivity in every type of products, it is advisable to use yarns with definite twist.

For a better understanding of this invention, consideration will be given to the following particular examples of its embodiment with reference to the accompanying drawings, wherein.

The proposed fibre and yarn therefrom are produced by a conventional method on conventional equipment. A particular example of producing the fibre from dry polycaproamide chips will now be considered.

EXAMPLE 1

Figure 1:
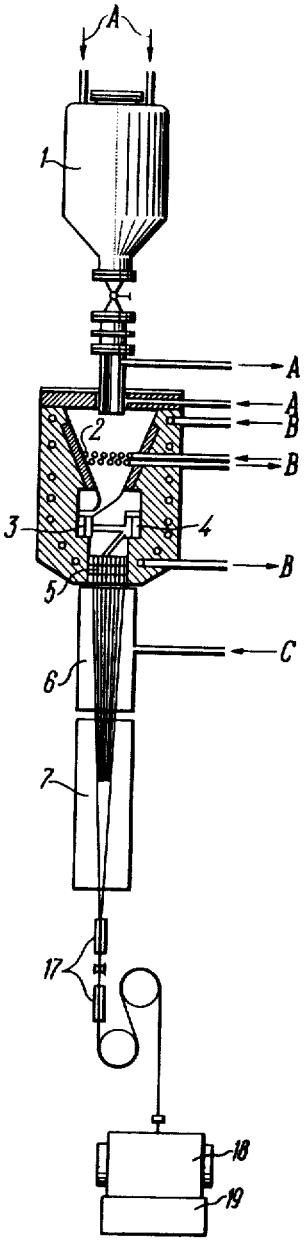
FIG. 1 shows the general diagram of a device for performing the process of producing yarn from the proposed fibre.

Dry polycaproamide chips sizing $d = (2 \div 3.5)$ mm, $l = (2.5 \div 4)$ mm are charged into bin 1 (FIG. 1) which is connected to a melting pot. The bin and the whole system up to the melting pot are thoroughly blown with nitrogen to preclude chips oxidation. Nitrogen feed is shown in the drawing by arrow "A".

From the bin, the chips flow by gravity to melting grid 2, where the chips are melted. The melting grid and jacket enclosing the entire spinning unit are heated by dynil vapours. Dynil supply is shown in the drawing by arrow "B".

The molten polymer is collected in a conical space under the grid 2, wherefrom it is sucked by delivery pump 3 and transferred to metering pump 4. The metering pump delivers the melt forcing it through a filter and spinneret 5, wherefrom it emerges in the form of thin regular jets.

Nitrogen is continuously blown through the space above the melting grid to prevent polymer oxidation during melting.

The jets of molten polymer emerging from the spinneret orifices pass through blowing tower 6 and spinning tower 7 and solidify into filaments under the effect of cool air supplied into blowing tower 6.

Figure 2:
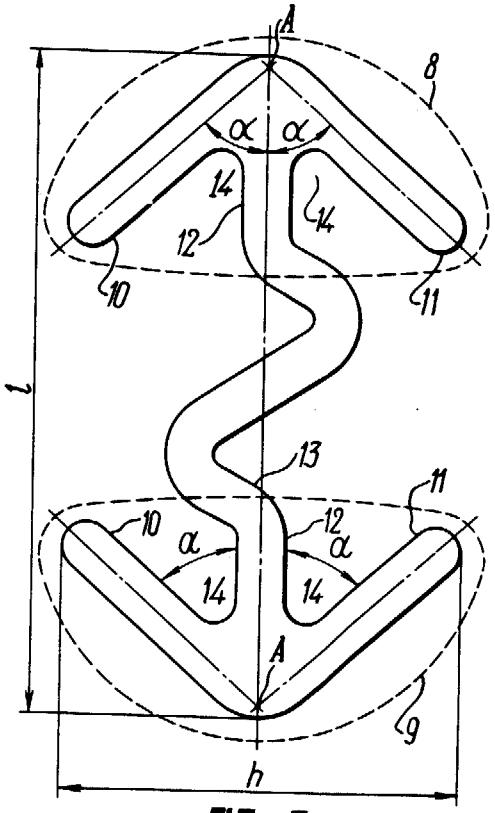
FIG. 2 shows a cross section of man-made fibre to an enlarged scale.

Supply of cooled air is shown in the drawing by arrow "C". Each of the filaments displays a complex cross-sectional shape formed of two elements, 8 and 9 (FIG. 2). Each of these elements is composed of three rays 10, 11, 12 outgoing from a single point A, two adjacent rays 10 and 12, 11 and 12 making up an angle $\alpha$ ranging from 10° to 70°. The presence of rays 10–12 arranged at said angle $\alpha$ diminishes the glitter by virtue of the reduced reflection from the surfaces of elements 8 and 9. Free ends of rays 12 are interconnected by flexible bridge 13 of the same material. Said arrangement of the rays and the bridge provides open capillary canals 14 extending over their whole run at the outer surface of elements 8 and 9. This raises the moisture conductivity and moisture absorpiton of the fibre, making them approximate those of natural silk.

The size of the capillary canals 14 is determined by the relation between the length "$l$" and the width "$h$" of the fibre cross section, which must lie within the range of $h/l = 0.2 \div 1.0$. These are most favourable conditions for providing effective moisture conductivity of the fibre.

Figure 3:
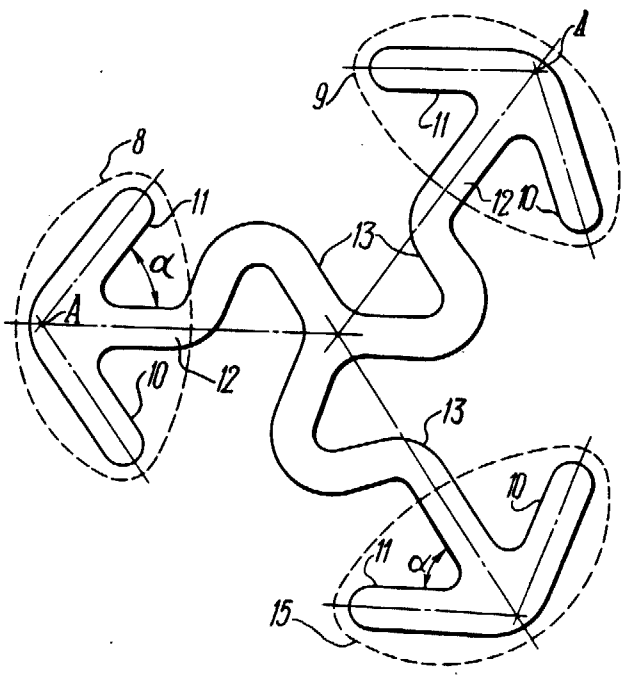
FIG. 3 shows an alternative cross section of man-made fibre to an enlarged scale.

To increase the capillarity of the fibre, a third element 15 identical to the first elements 8 and 9 is connected approximately to the mid-point of the flexible bridge 13 (FIG. 3).

Figure 4:
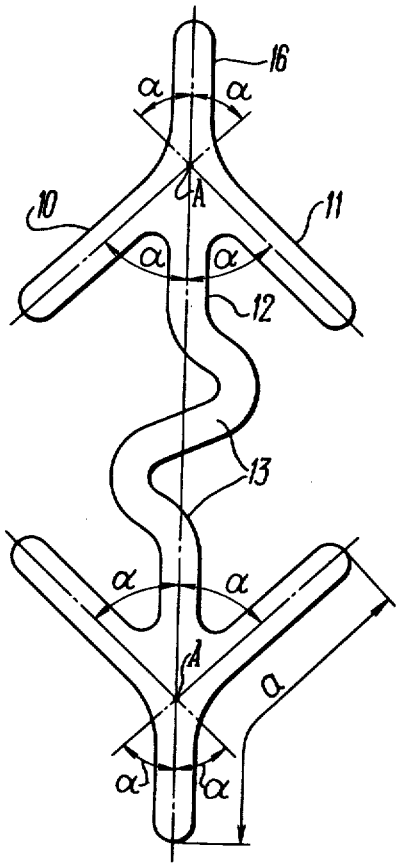
FIG. 4 shows a cross section of fibre having an an additional ray, to an enlarged scale.

To provide a fibre with very high resilience and elasticity, the approximate mid-portion of the flexible bridge 13 (FIG. 4) is zigzag-shaped. Each of the elements has an additional ray 16 outgoing from point "A" and forming a continuation of the middle ray 12. The length of this ray 16 does not exceed that of each ray 10 or 11. This additional ray increases the concavity in the portion "$a$", and the fibre reflectivity is thereby reduced to approximate that of natural silk.

The above described filaments emerge as fine jets from the spinning tower 7 (FIG. 1) and coming in contact with preparation discs 17, arrive to cylindrical take-up bobbin 18 weighing at least 3000 g, which is driven by friction roll 19.

In the winding zone, constant climatic conditions shall be maintained:

temperature (T° C) – 18±1,
specific humidity (%) – 48±2

Then the resultant freshly spun filament is cold-drawn and after-twisted on a winding and drawing machine at a speed of 850 m/min and draw ratio of 1:2.78.

Figure 6:
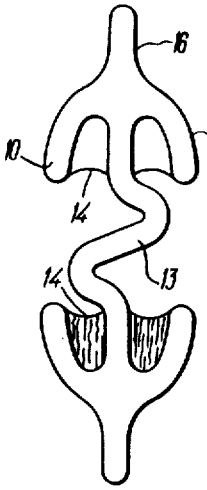
FIG. 6 shows the yarn of FIG. 5, but in twisted condition.
Figure 5:
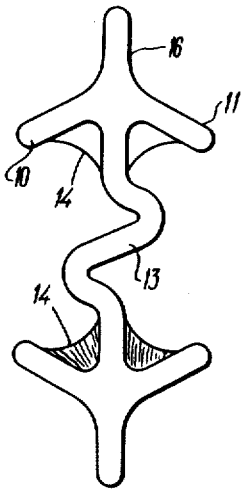
FIG. 5 shows a cross section of yarn formed of the proposed fibres, untwisted.

FIGS. 5 and 6 show correspondingly the yarn untwisted and the yarn twisted within 100 to 2000 T.P.M.

As will be apparent from FIG. 6, unbent rays 10 and 11 are, by virtue of twist, pressed toward interconnecting bridge 13 this being conducive to enlarging the surface of the capillary canals 14, and thereby to raising the moisture conductivity of the product made of such yarn.

Figure 7:
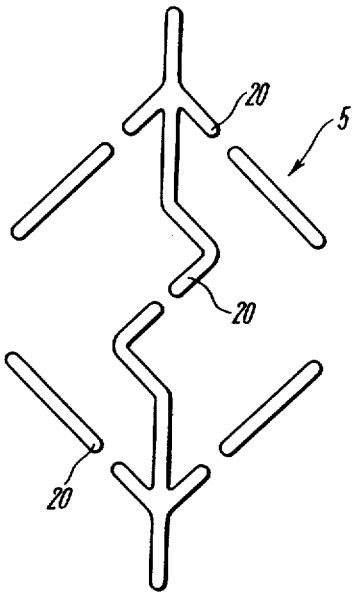
FIG. 7 shows a cross section of the spinneret orifice to an enlarged scale.

As described above, the cross-section of the fibre is dependant on the configuration of spinneret 5. Though the yarn-forming orifices 20 (FIG. 7) of this spinneret may have the shape of an interrupted slot, but as the polymer used for manufacture of fibre exhibits fluidity the resulting fibre has the above said configuration.

As a result, a compound 2.2 tex (20 denier) linear density yarn composed of seven filaments is obtained, Physical and mechanical properties of this yarn are given in Table 1. Physical and mechanical properties of natural silk with the 2.3 tex (21 denier) linear density, most widely used in silk fabrics manufacture, are given in the same Table for comparison. The yarn made from the proposed polycaproamide fibre will hereinafter be referred to as "Shelon" for the sake of brevity.

Table 1

| Nos. | Characteristics | Yarn denomination "Shelon" | Yarn denomination Natural silk |
|---|---|---|---|
| 1 | 2 | 3 | 4 |
| 1. | Linear density, tex (denier) | 2.20 (20) | 2.33 (21) |
| 2. | Moisture absorption, % | 5.6 | 11.0 |
| 3. | Moisture conductivity, mm | 7.8 | 4.8 |
| 4. | Electrification, mm | 2.4 | 1.7 |
| 5. | Specific strength, gf/tex | 41.0 | 30.2 |
| 6. | Breaking elongation, % | 17.8 | 16.9 |
| 7. | Breaking stress, kgf/mm$^2$ | 46.7 | 41.1 |
| 8. | Rupture work, kgf/cm | 0.47 | 0.52 |
| 9. | Specific strength, % | | |
| | - knot strength | 8.5 | 86 |
| | - loop-break strength | 79 | 83 |
| 10. | Initial modulus, kgf/mm$^2$ | 6.6 | 11.7 |
| 11. | Complete deformation, % | 4.1 | 2.0 |
| 12. | Components of complete deformation: | | |
| | - recovered | 0.93 | 0.45 |
| | - permanent | 0.07 | 0.55 |
| 13. | Stiffness in twisting, rel. units | 104 | 215 |
| 14. | Fatigue) strain) life, number of cycles, thousands: | 50 | 0.7 |
| 15. | Flexing life, number of cycles, thous | 66 | 0.5 |
| 16. | Abrasion resistance, number of cycles, thousands | 20 | 4.0 |
| 17. | Friction factor | 0.13 | 0.14 |

As can be seen from Table 1 the novel filaments "Shelon" feature a number of positive properties of natural raw silk and are superior to it in service characteristics. Outstanding physical properties of the novel filament: moisture absorption and moisture conductivity (most valuable property imparting efficient hygienic performance to textiles) should be particularly noted.

Said advantages of the novel filaments and of products manufactured therefrom are ensured by the proposed cross-sectional configuration of the fibre, and in particular by the cross-section displaying open capillary canals communicating over their whole run with the outer surface of the fibre and arranged at a definite angle thereto.

According to the present invention, filaments of different linear density grades, preferably medium and high, ranging within 1.67 to 6.68 tex (15–60 denier) can be produced.

Synthetic polymers such as polyamide, polyester, polyolefine, polyacryl, etc., can be used for producing the proposed fibre and yarn therefrom.

To form filaments from thermoplastic polymers and in particular from polycaproamide the following conditions shall be met:

relative viscosity of polymer shall be within the range of 2.2–3.0:

| | |
|---|---|
| temperature of melt | 250 - 306° C; |
| rate of forming | 850 - 1200 m/min; |
| draw ratio | 1:2.5 - 1.55; |
| linear speed | 850 - 1300 m/min |

While forming and drawing the freshly formed fibre, the climatic conditions shall be kept constant. It is also required that the fibre cross section be controlled at regular intervales.

Only steady control over the whole spinning process ensures the producing of fibre with a cross section constant over the whole length thereof, hence with effective geometrical, physical and mechanical properties.

The novel filaments possess high strength, outstanding resistance to multy-cycle effects, dye well and have moisture absorption and moisture conductivity approximating those of natural silk.

Such filaments can be made into various fabrics ranging from fine delicate materials for end use in dresses and blouses, lingerie, head shawls (1 sq. m weighing 25 to 50 g) to heavier materials for costume and dress purposes (1 sq. m weighing 80 to 100 g), thus covering practically the whole variety of fabrics currently manufactured from natural silk.

EXAMPLE 2

According to the present invention, any material used in producing man-made compound filaments including polyethylene terephtalate, can be used as a thermoplastic polymer.

In this case, a melt of polyethyleneterphtalate with 0.63/$\eta$/ (viscosity of 8 percent o-chlorophenol solution of said melt at T 25° C) and a 0.15 percent $TiO_2$ content is extruded at the rate of 885 m/min at 280° to 290° C. Air for cooling is usually supplied at a rate of 8–16 cub. m/hour per extruding assembly.

The linear density of the resultant freshly formed yarn is equal to 15.6 tex (150 denier).

Then, the yarn is drawn and aftertwisted under the following conditions: linear speed, 625 m/min; ratio, 1:3.66; temperature, 90°/160° C.

The properties of the finished polyethylenetherephtalate filament are given in Table 2.

Table 2

| Nos. | Characteristics | |
|---|---|---|
| 1. | Linear density, tex(denier) | 4.44(40) |
| 2. | Moisture conductivity, mm | 35 |
| 3. | Specific strength, gf/tex | 40.5 |
| 4. | Breaking elongation, % | 19.8 |
| 5. | Specific strength, % | |
| | - knot strength | 102.1 |
| | - loop-break strength | 84.1 |
| 6. | Stiffnes in twisting, rel. units | 91 |
| 7. | Fatigue (strain) life, number of cycles, thousands | 0.151 |
| 8. | Flexing life, number of cycles, thousands | 35.7 |
| 9. | Abrasion resistance, number of cycles, thousands | 4.7 |

EXAMPLE 3

Filaments produced from the proposed fibre are twisted within 100 to 2000 T.P.M. The twisting affects basically the moisture conductivity and moisture absorption of fabrics and thereby their hygienic and comfort properties. The moisture conductivity and moisture absorption characteristics are most essential for evaluation of comfort properties, they determine the level of perspiration, electric resistance of skin, and the moisture losses.

Table 3

| Nos. | Characteristics | Fabrics I | II | III |
|---|---|---|---|---|
| 1. | Twist range, T.P.M. | | | |
| | - warp | 600 | 1000 | 350 |
| | - weft | 150 | 150 | 1000 |
| 2. | Moisture absorption, % | 103 | 167 | 152 |
| 3. | Moisture conductivity, mm | 26 | 61 | 68 |
| 4. | Density (number of threads per 10 cm) | | | |
| | - warp | 441 | 473 | 410 ×2 |
| | - weft | 444 | 376 | 429 |

The experimental data presented in Table 3 demonstrate that filaments of a higher twist used in warp or weft of fabrics will increase its moisture conductivity by about 2.5 times and its moisture absorption by about 1.5 times.

All the three fabrics are linen-weave types for fancy women's dresses, blouses, and head shawls, they are fine and delicate showing minimal loading, and weighing 22 to 47 g per sq.m.

The complex shape of the proposed fibre imparts resilient properties and softness to fabrics increasing their resistance to slippage.

The silk-like handle and effective cover is achieved through definite combination of twist types for warp and weft yarns.

Once the process specifications for silk cloth manufacture are met, the mechanical loom weaving proceeds without problems.

EXAMPLE 4

This example presents data on hygienic and some other properties of natural silk cloth as compared to those of fabric made from "Shelon" filaments. These data are given in Table 4.

Table 4

| Nos. | Characteristics | Natural Silk Cloth | "Shelon", Cloth |
|---|---|---|---|
| 1 | 2 | 3 | 4 |
| 1. | Weight of 1 sq.m, g | 31.2 | 25.5 |
| 2. | Density (number of threads per 10 cm) | | |
| | - warp | 370 | 441 |
| | - weft | 380 | 402 |
| 3. | Moisture absorption, % | 257 | 166 |
| 4. | Moisture conductivity, mm | 23 | 35 |
| 5. | Air penetration, $1/m^2$ sec. | 2950 | 3670 |
| 6. | Strength, kgf | 23.8 | 14.2 |
| 7. | Breaking elongation, % | 28.9 | 26.1 |
| 8. | Draping, % | 42 | 53 |
| 9. | Crumpling resistance, % | 78 | 78 |
| 10. | Resistance to slippage, kgf | 0.6 | 1.0 |
| 11. | Abrasion resistance, number of cycles | 12 | 250 |
| 12. | Shrinkage, % | −1.6 | 0.1 |

As can be seen from Table 4, the moisture conductivity of fabric made of "Shelon" fibre is increased by 1.5 times, while the moisture absorption and air-penetration characteristics of both fabrics are maintained at a fairly high level.

Tested in a climatization chamber at an air temperature of 24°, 30° and 35° C with no wind on calmly sitting test persons, the blouses tailored of these fabrics exhibited high comfort characteristics of textiles. For instance, the electric skin resistance data show that the growth and the level of perspiration are nearly equal.

No annoying subjective tactile sensations are noted.

Moisture losses for the blouse of natural silk is 95 g/hour; and those for the blouse made of "Shelon" fibre is 80 g/hour. It can therefore be concluded that the blouse made of "Shelon" fibre possesses satisfactory hygienic properties and can be used alongside with garments from natural silk meant for similar purposes.

EXAMPLE 5

In huckaback and mixed weaves for fancy men's shirts, a definite combination of twist types for warp and weft yarns provides not only external effects like crepe, higher or lower softness (stiffeness), covering power, but also affects their hygienic properties.

Characteristics of two huckaback weaves with different combinations of twist types for warp and weft yarns are given in Table 5.

Table 5

| Nos. | Characteristics | Fabrics I | II |
|---|---|---|---|
| 1 | 2 | 3 | 4 |
| 1. | Twisting range, T.P.M. | | |
| | - warp | 1000 | 1000 |
| | - weft | 150 | 1000 |
| 2. | Moisture absorption, % | 119 | 134 |
| 3. | Moisture conductivity, mm | 120 | 161 |
| 4. | Air penetration, $1/m^2$ sec | 246 | 471 |
| 5. | Stiffeness, mg. $cm^2$ | 26 | 41 |
| 6. | Draping, % | 37 | 44 |
| 7. | Weight of 1 sq.m, g | 75 | 75 |
| 8. | Density (number of threads per 10 cm) | | |
| | - warp | 640 | 640 |
| | - weft | 380 | 380 |

Resultant fabric with twist combination 1000 T.P.M. in warp and 150 T.P.M. in weft (I) is flat and has effective cover, its stiffeness is 1.6 times lower than that of analogous fabric with twist combination 1000 T.P.M. in both warp and weft (II). Water absorption of this fabric (I) is by 12 percent lower, moisture conductivity is 1.3 times lower, and air penetration is almost 2 times lower than that in alternative fabric II.

Thus, varying the twist grades for warp and weft threads and the conbination thereof makes it possible to produce goods which display comfort and sound marketable apperance, and are intended for various climatic zones.

EXAMPLE 6

Table 6 presents some of physical properties of two fabrics for end use in dresses and blouses, 1 sq.m. of the said fabrics weighing about 25 g, warp and weft of the said fabric being composed of 2.2 tex (21 denier – 7 fil.) compound filaments of "Shelon" fibre with high twist grades: fabric I - satin weave, fabric II - linen weave.

Table 6

| Nos. | Characteristics | Fabrics I | II |
|---|---|---|---|
| 1. | Twist range, T.P.M. | | |
| | - warp | 1000 | 1500 |
| | - weft | 1000 | 1500 |
| 2. | Water absorption, % | 171 | 166 |
| 3. | Moisture conductivity, mm | 118 | 135 |
| 4. | Air penetration, $1/m^2$.sec | 411 | 3666 |
| 5. | Draping, % | 38 | 53 |
| 6. | Density (number of threads per 10 cm): | | |
| | - warp | 60 | 40 |

Table 6-continued

| Nos. | Characteristics | Fabrics I | Fabrics II |
|---|---|---|---|
| | - weft | 48 | 40 |

EXAMPLE 7

Multifilament yarns of 2.2 tex (21 - denier - 7 filaments) are textured by way of false twist using conventional equipment. Table 7 presents experimental data on textured polyamide "Shelon" yarns and fabric manufactured therefrom.

Table 7

| Nos. | Characteristics | "Shelon" yarn | Fabric |
|---|---|---|---|
| 1. | Moisture absorption, % | 5.7 | 168 |
| 2. | Mositure conductivity, mm | 42.1 | 21.5 |
| 3. | Electrification, mm | 2.1 | — |
| 4. | Air penetration, $1/m.^2$ sec | — | 124 |

Ready-made textured fabrics display outstanding marketable appearance, soft handle and draping, pleasant feel.

EXAMPLE 8

Polyamide yarns of 5 tex (45 denier - 14 filaments) linerar density were made into haberdashery: thin, dense, fairly crumple-resisting linen weave weighting 38 g per 1 sq.m, and four-shaft satin weave weighing 49 g per 1 sq.m.

Fabrics were finished by film-screen printing, trap printing, and free painting.

Warp and weft of both fabrics are composed of S-way twisted filaments. Characteristics and hygienic properties of fabrics are presented in Table 8.

Table 8

| Nos. | Characteristics | linen | satin |
|---|---|---|---|
| 1. | Twisting range, T.P.M. | | |
| | - warp | 550 | 550 |
| | - weft | 350 | 350 |
| 2. | Density (number of threads per 10 cm) | | |
| | - warp | 398 × 2 | 354 |
| | - weft | 551 × 2 | 399 |

Table 8-continued

| Nos. | Characteristics | linen | satin |
|---|---|---|---|
| 3. | Moisture absorption, % | 161 | 134 |
| 4. | Moisture conductivity, mm | 78 | 85 |
| 5. | Air penetration, $1/m^2$ sec | 1284 | 615 |

Presented fabrics are meant for end use in kerchiefs, neckties, head shawls, scarves.

Comparatively low twist characteristics were chosen with variety of mass-produced goods in view. Beneficial combination of twist grades and weave types allows producing high comfort fancy fabrics.

We claim:

1. A man-made fibre of a material selected from the group consisting of polycaproamide and polyethylene terephthalate and displaying a complex cross-sectional shape formed of at least two elements each comprising three rays namely two outer rays and one middle ray situated between said outer rays, said rays of each element all intersecting each other at and emanating from a single point, with the rays of each element extending from said point thereof generally toward the rays of the other element, and said middle ray of each element forming with each outer ray thereof an angle within 10° to 70°, said middle and outer rays of each element defining between themselves open capillary canals adding to mechanical cohesion between individual fibres, and a flexible bridge extending between, forming an extension of, and interconnecting the middle rays of both elements, said bridge being formed of the same material as the elements.

2. A man-made fibre according to claim 1, in which a third element identical to the said two elements is connected approximately to the midpoint of the flexible bridge.

3. A man-made fibre according to claim 1, in which the mid-portion of said bridge is zigzag-shaped.

4. A man-made fibre according to claim 1, in which each of said elements displays an additional ray outgoing from said point, said additional ray being a continuation of said middle ray, the length of this additional ray not exceeding that of each of the rays not interconnected by bridge.

5. A yarn formed of fibres as defined in claim 1, said yarn displaying twist range within 100 to 2000 T.P.M.

6. A textile, in which yarn formed of fibres as defined in claim 5 is used for the manufacture of said textile.

* * * * *